United States Patent [19]

Gavrilov et al.

[11] 4,004,420

[45] Jan. 25, 1977

[54] HYDROPNEUMATIC PUMPING ARRANGEMENT

[76] Inventors: Anatoly Nikolaevich Gavrilov, Kutuzovsky prospekt, 43, kv. 118; Eduard Moiseevich Godin, Begovaya ulitsa, 22, korpus 3, kv. 212, both of Moscow; Leonid Nikolaevich Kebets, Kuibyshevskoi oblasti, ulitsa Sverdlova, 183, kv. 45, Tolyatti; Ivan Zakharovich Beregovoi, Kuibyshevskoi oblasti, Moskovsky prospekt 46, kv. 77, Tolyatti; Vladimir Ivanovich Matskevich, Kuibyshevskoi oblasti, Moskovsky prospekt 66, kv. 45, Tolyatti; Yakov Osherovich Korf, Kuibyshevskoi oblasti, Revoljutsionnaya ulitsa 63, kv. 237, Tolyatti; Alexandr Grigorievich Dorofeev, Kuibyshevskoi oblasti, ulitsa Stepana Razina 99, kv. 385, Tolyatti, all of U.S.S.R.

[22] Filed: Sept. 26, 1975

[21] Appl. No.: 617,057

[52] U.S. Cl. ..... 60/464; 60/486; 417/339

[51] Int. Cl.[2] ..... F15B 15/18

[58] Field of Search ..... 60/375, 378, 413, 428, 60/464, 486; 417/339, 225, 3; 91/170 R

[56] References Cited

UNITED STATES PATENTS

| | | | |
|---|---|---|---|
| 2,508,298 | 5/1950 | Saari | 417/225 |
| 2,938,347 | 5/1960 | Sturgis | 60/456 |
| 3,249,053 | 5/1966 | Govan | 417/339 X |
| 3,405,522 | 10/1968 | Tomita | 417/339 X |

*Primary Examiner*—Edgar W. Geoghegan

[57] ABSTRACT

A hydropneumatic pumping arrangement comprising at least two double-acting hydropneumatic force multipliers, pneumatic chambers of pneumatic cylinders of the multipliers communicating, through two two-position directional valves with an air source, and the chambers communicating through hydraulic non-return valves, with hydraulic pressure and return lines connected to actuating hydraulic cylinders of the associated processing equipment. The valves are cylindrical slide valves, an inlet passage of one slide valve is in communication with an air source and outlet passages are in parallel communication with the pneumatic chambers and with control chambers of another slide valve, outlet passages thereof being in communication with the control chambers of the one slide valve of the other force multiplier for alternate communication of the pneumatic chambers of both multipliers with the air source in the course of travel of the pistons of the pneumatic cylinders thereof. Non-return hydraulic valves are interconnected in two bridge circuits, and there is a system provided for compensating the working fluid flowing out from the chambers of the actuating hydraulic cylinders, which system has its inlets connected with one of the diagonals of each bridge circuit, preferably also communicating them in parallel with the hydraulic chambers of a respective force multiplier, and the other diagonals of each bridge circuit being preferably in communication with the hydraulic pressure and return lines.

6 Claims, 3 Drawing Figures

HYDROPNEUMATIC PUMPING ARRANGEMENT

The present invention relates to the field of mechanical engineering and more particularly to "variable displacement" hydropneumatic pumping arrangements which have found wide application in many branches of industry as pressure sources in hydro-electric power units of processing equipment, wherein a wide range of variations in operating speeds and forces is required in the actuating units, for example, in welding equipment, metal-cutting machines, and rolling mills.

The present invention may be employed most successfully in processing equipment working under conditions of radiation, explosion hazards, in hot and chemical processes, wherein electric control circuits cannot be used.

There are known hydropneumatic pumping arrangements (cf. U.S. Pat. No. 2,858,767;) comprising at least two double-acting hydropneumatic force multipliers, the pneumatic chambers of the pneumatic cylinder of each multiplier communicating, through two two-position directional valves, with an air source, and the hydraulic chambers of both units communicating, through non-return hydraulic valves, with pressure and drain hydraulic lines connected to actuating hydraulic cylinders of the associated processing equipment.

In such hydropneumatic pumping arrangements, one of the two-position directional valves of each hydropneumatic force multiplier is a cylindrical slide valve acting as a control slide valve, and the other two-position directional valve is flat and is kinematically associated with the first one, both slide valves being housed in a common body of a distribution panel.

On delivering pressure into the control chamber of the cylindrical slide valve, the flat slide valve (due to the kinematic association) is shifted to one of the two extreme positions.

The main disadvantage of the "prior art" hydropneumatic pumping arrangements is their relatively low reliability which is due to the following reasons.

Without proper sealing, it is difficult to eliminate leakage of compressed air at the point of contact of the flat slide valve with the body of the distribution panel, which also essentially reduces the efficiency of the arrangement.

Besides, since all cylindrical valves are arranged unilaterally, the compressed air in the distributing channel of each valve considerably increases the force of friction of this valve against the body of the distribution panel, which in some cases may cause jamming of this slide valve.

Another disadvantage of the known hydropneumatic pumping arrangements is that the hydraulic pressure pistons of the hydropneumatic force multipliers are designed as differential members which does not provide for maximum efficiency of the pumping arrangement either, as the volume of the working fluid forced into the actuating hydraulic cylinders of the associated equipment, when their pistons perform a downward stroke, is larger than that of the fluid moved during an upward stroke, resulting in an increased number of working cycle reversals, thereby reducing the efficiency and service life of the associated production equipment.

It should also be borne in mind that throttling holes made in the heads of the hydraulic pistons of the hydropneumatic force multipliers, through which the working fluid is forced into the chambers of the actuating hydraulic cylinders, create additional pressure difference in the hydraulic line when their pistons perform downward strokes and cause heating of the working fluid, which also results in reducing the pumping arrangement efficiency and, in some cases, in the necessity of using a cooling system, i.e. increasing operational expenses.

Besides, in the known arrangements, the filling of the hydraulic chambers of each hydropneumatic force multiplier, when the hydraulic piston performs an upward stroke, is performed through the non-return valve as a result of suction in the hydraulic chamber being emptied.

At definite velocities (large flows of the working fluid), this may result in partial filling of the hydraulic chambers of the force multipliers and, as a consequence, in pressure drops in the pressure line, which causes interruptions in the operation of the pumping arrangement.

It is an object of the present invention to eliminate the above disadvantages.

The invention is aimed at providing a hydropneumatic pumping arrangement with a system of pneumatic and hydraulic directional valves that eliminates compressed-air leakage from air passages, ensures quick action of the pneumatic and hydraulic directional valves in the course of reversal of the hydropneumatic force multipliers, maximum travel of their pistons, forced filling of one of the hydraulic chambers of each force multiplier during delivery of the working fluid from another hydraulic chamber, and maximum uniform flow of the working fluid toward the actuating hydraulic cylinders, which ultimately permits substantially raising the efficiency of the pumping arrangement, increasing its service life and ensuring reliable operation thereof.

These and other objects are attained in a hydropneumatic pumping arrangement comprising at least two double-acting hydropneumatic force multipliers, pneumatic chambers of pneumatic cylinders of these force multipliers communicating, through two two-position directional valves, with an air source, and the hydraulic chambers of both force multipliers communicating, through non-return hydraulic valves, with pressure and return hydraulic lines connected to actuating hydraulic cylinders of the associated processing equipment.

According to the invention, both two-position directional valves are cylindrical slide valves, one of them being a distributing one and the inlet passage thereof being in communication with the air source, while the outlet passages thereof are in parallel communication with the pneumatic chambers of a respective hydropneumatic force multiplier and with the control chambers of the second two-position directional valve which is a control valve, and the outlet passages thereof are in parallel communication with the control chambers of the first two-position directional valve of the other hydropneumatic force multiplier for alternate communication of the pneumatic chambers of both hydropneumatic force multipliers with the air source in the course of travel of the pistons of the pneumatic cylinders.

The non-return hydraulic valves are interconnected in two bridge circuits, and there is a system provided for compensating the working fluid flowing out from the chambers of the actuating hydraulic cylinders, which system has its inlets connected with one of the diagonals of each bridge circuit, preferably also communicating them in parallel with the hydraulic chambers of a respective hydropneumatic force multiplier. The other diagonals of each bridge circuit are preferably in communication with the pressure and return lines.

The substitution of the kinematic connection between the control and distributing two-position valves for a pneumatic one, as well as the introduction into the pumping arrangement of bridge circuits, and a system for compensating the working fluid flowing out from the chambers of the actuating hydraulic cylinders, makes it possible to practically eliminate compressed-air leakage from the pneumatic chambers, to simplify the structure of the distributing slide valves, and to eliminate jamming of the power control slide valves in the process of their switching, which enhances the reliability and efficiency of the pumping arrangement.

It is recommended that the arrangement has two two-position three-way valves with unilateral pneumatic control, and in the cylinder sleeve walls of each force multiplier there are made two rows of radially arranged through openings, the openings of one of these rows being in communication, through a common passage, with the control chambers of one of the three-way valves, and the openings of the other row with the inlet passage of this valve. The distance between the rows of openings along the generatrices of the sleeves is chosen such as to ensure dephasing of the pistons of both force multipliers in the course of operation, the time of their joint travel being minimum.

Since the arrival of a command signal at the inlet of the two-position directional valve through the distributing channel of the two-position three-way valve is strictly timed, there is a possibility for the pressure pistons of a respective force multiplier to perform a full stroke and remain at the end of the stroke for a specified period of time in the case of optimum dephasing of the pistons, which permits enhancing the efficiency of the pumping arrangement, reducing the number of working cycles, and increasing the service life thereof.

The coupling of the pneumatic chambers of the pneumatic cylinders with the three-way valve and further, through a two-position four-way valve, with the control chamber of the power distributor of the other pneumatic cylinder through a row of radially arranged openings communicating through a common channel, permits enhancing the quick action of the pneumatic control circuit and, consequently, to improve its dynamic characteristics. The sizes of the control openings may be chosen such that they practically do not affect the service life of the seals in the force multipliers.

The system of working fluid flow compensation may be made up of four controlled non-return hydraulic valves, the outlet of each valve being in communication with one of the hydraulic chambers of one of the force multipliers, and the control chambers of these controlled hydraulic valves are in communication with the opposite hydraulic chamber of the same force multiplier, all controlled hydraulic valves being connected through a common inlet with an outlet of a hydropneumatic accumulator which has its inlet communicating with the air source through a pneumatic a safety valve and a pneumatic reducer.

As a result of the working fluid being admitted from the return chamber of an actuating hydraulic cylinder through a respective hydraulic directional valve passage into the return line, and further, through the non-return valve of a respective hydraulic bridge circuit, into a respective force multiplier hydraulic chamber, the compensation for the outflowing working fluid is effected automatically by a respective controlled non-return valve opened by the control pressure from the hydraulic chamber of the other force multiplier from which the working fluid is forced into the pressure line.

Thus, two-way communication is ensured between the filled hydraulic chamber of each force multiplier and the hydropneumatic accumulator, wherein some excess pressure from the compressed air line is maintained, owing to which forced filling of the hydraulic chambers of the force multipliers takes place. Therewith, when stemless chambers of the actuating hydraulic cylinders are emptied, excessive working fluid is also forced through the return line into the accumulator.

Consequently, the proposed compensation system ensures forced filling of the force multiplier chambers in the process of forcing the working fluid from the other multiplier chamber, which also improves the reliability of the pumping arrangement and rules out the possibility of pressure drops in the pressure line.

According to one of the exemplary embodiments of the invention, the hydropneumatic pumping arrangement comprises a hydraulic force multiplier whose high-pressure chamber is in parallel communication with the hydraulic directional valves of the actuating hydraulic cylinders, while stem-fitted and stemless chambers of this hydraulic force multiplier are in communication with the outlets of the two-position four-way hydraulic directional valve, the inlet passages thereof being in communication with the working-fluid automatic pressure control circuit in the course of operation.

This embodiment also enables increasing the efficiency of the pumping arrangement when it is used in welding, pressing, machine-tool manufacturing and other equipment, i.e. performing working cycles that necessitate rapid feed of the actuating mechanisms to the workpiece with further boosting of the force of the actuating hydraulic cylinder, for example, in multiple clamping devices and welding guns.

This is attained in that the driving mechanism is provided with an automatic control circuit for the pressure if it exceeds that in the pressure line of the hydropneumatic pumping arrangement.

It is also recommended that the working-fluid automatic pressure control circuit has an "n-way" electrically controlled hydraulic directional valve whose inlet and return passages communicate with the pressure and return hydraulic lines, while the outlet passages with hydraulic pressure regulators communicate, in turn, with the inlet passages of the non-return valves, and their common outlet communicates with the inlet of the two-position four-way electrically controlled hydraulic directional valve.

Such an embodiment permits improving the power characteristics of the hydropneumatic pumping arrangement owing to the hydropneumatic force multipliers forcing the working fluid into the pressure line with the pressure required for performing auxiliary strokes of the actuating hydraulic cylinders, the high pressure being built up by the circuit in the course of boosting the force of the actuating hydraulic cylinders.

According to another embodiment of the invention, the hydropneumatic pumping arrangement comprises a hydraulic force multiplier whose high-pressure chamber communicates with the stemless chambers of the actuating hydraulic cylinders and is isolated from the outlet channel of a hydraulic directional valve by a controlled non-return valve, the inlet channel thereof communicating with the inlet channel of the hydraulic directional valve, and the inlet channel of the valve is in parallel communication with the pressure chambers of actuating hydraulic cylinders and with the "high pressure" chamber of the hydraulic force multiplier, the control channel of the non-return valve being in communication with the other outlet of the hydraulic directional valve.

Such an embodiment permits increasing the pumping arrangement efficiency and cutting down its manufacturing cost in those cases where the actuating hydraulic cylinders have to be maintained under high pressure for long periods of time.

This is due to the fact that the leaky hydraulic equipment is removed from the high-pressure circuit into the low pressure hydraulic line, since the high-pressure hydraulic chamber of the hydraulic force multiplier is connected directly with the stemless chamber of the actuating hydraulic cylinder, and its isolation from the pressure hydraulic line is effected by the controlled non-return valve.

Consequently, the cost of some hydraulic elements is reduced since high pressure in the hydraulic system imposes more stringent requirements on the structure and performance of the hydraulic equipment.

Given below is a detailed description of specific exemplary embodiments of the present invention with reference to the accompanying drawings, in which.

Figure 1:
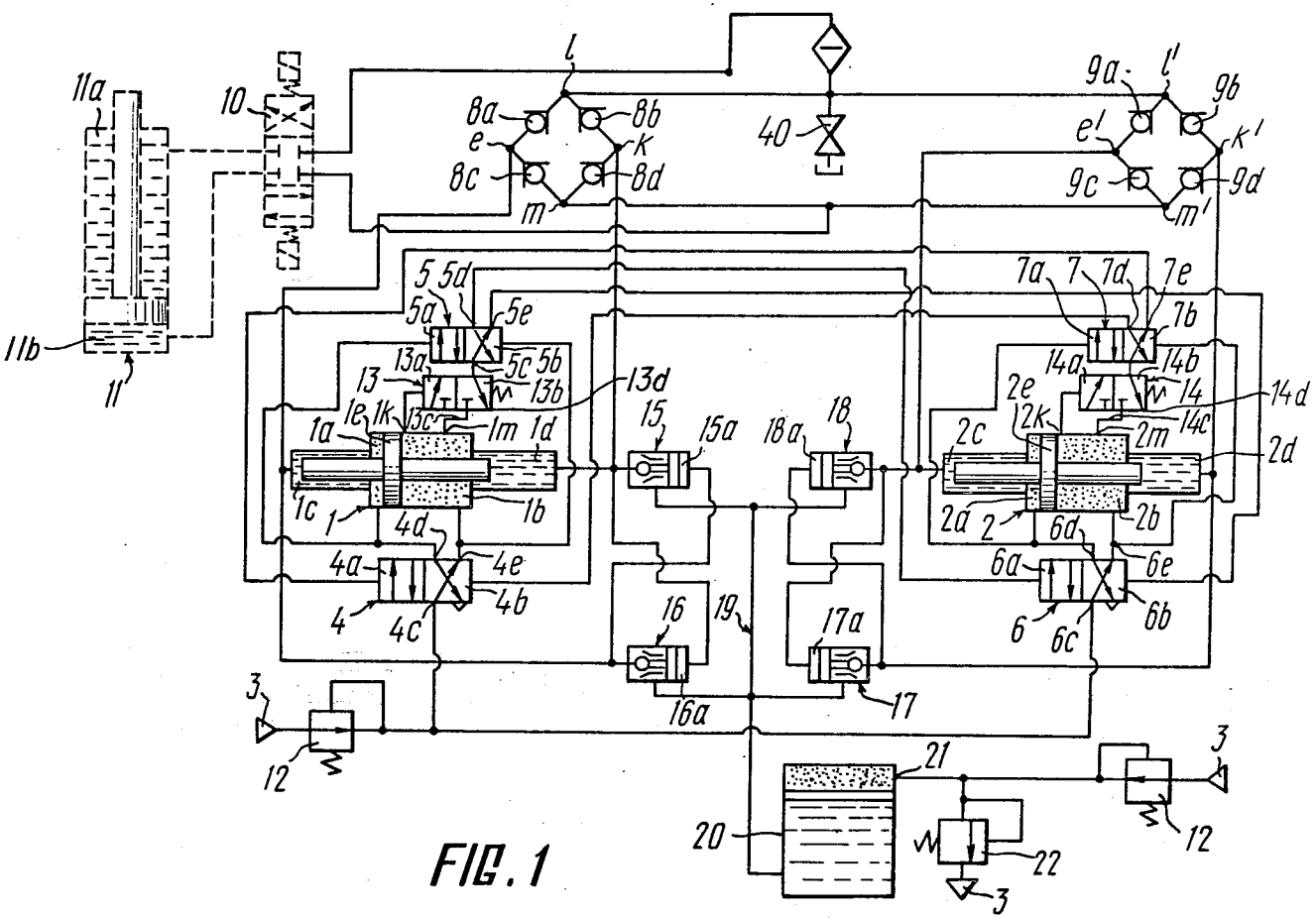
FIG. 1 shows schematically a hydropneumatic pumping arrangement according to the invention.

The hydropneumatic pumping arrangement comprises two double-acting hydropneumatic force multipliers 1 and 2 (FIG. 1), each having a pneumatic cylinder with two pneumatic chambers 1*a*, 1*b* and 2*a*, 2*b*, respectively, and two hydraulic chambers 1*c*, 1*d* and 2*c*, 2*d* communicating therewith.

The pneumatic chambers 1*a*, 1*b* (2*a*, 2*b*) of each hydropneumatic force multiplier, respectively, 1 and 2 communicate with an air source through two two-position directional valves 4 and 5 (6 and 7), and the hydraulic chambers 1*c*, 1*d* (2*c*, 2*d*) communicate through non-return valves 8*a*, 8*b*, 8*c* and 8*d* (9*a*, 9*b*, 9*c* and 9*d*) with pressure and return hydraulic lines to which the actuating hydraulic cylinders of the associated processing equipment are connected through a hydraulic directional valve 10.

According to the invention, each two-position directional valve 4 and 5 (6 and 7) is a cylindrical slide valve with two control chambers 4*a* and 4*b*; 5*a* and 5*b*; 6*a* and 6*b*; 7*a* and 7*b*, respectively.

The first two-position directional valve 4 (6) of each said pair (4, 5) and (6, 7) of the two-positional valves is a distributing valve and has its inlet passage 4*c* (6*c*) communicating through a reducer 12 with the air source 3, and outlet passages 4*d* and 4*e* (6*d* and 6*e*) are in parallel communication with the pneumatic chambers 1*a*, 1*b* (2*a*, 2*b*), respectively, of the pneumatic cylinders of the force multipliers 1 and 2 as well as with the control chambers 5*a* and 5*b* (7*a* and 7*b*) of the second two-position directional valve 5 (7) of the same pair 4, 5 (6, 7) of two-position valves.

Each two-position valve 5 (7) is a control valve and outlet passages 5*d* and 5*e* (7*d* and 7*e*) thereof are in parallel communication with the control chambers 6*a* and 6*b* (4*b* and 4*a*) of the first valve of said second pair (4, 5) and (6, 7) of two-position valves for alternate communication of the pneumatic chambers 1*a*, 1*b* (2*a*, 2*b*) of the pneumatic cylinders of the hydropneumatic force multipliers 1 and 2 with the air source 3 in the course of travel of the pistons 1*e* and 2*e*.

According to the invention, the non-return hydraulic valves 8*a*, 8*b*, 8*c*, 8*d* and 9*a*, 9*b*, 9*c*, 9*d* are interconnected in fours, forming two bridge circuits. One of the diagonals "*e–k*" (*e'–k'*) of each of these bridge circuits communicates with the hydraulic chambers 1*c* and 1*d* (2*c* and 2*d*) of respective hydropneumatic force multipliers 1 and 2, and the second diagonals "*l–m*" (*l'–m'*) of these bridge circuits communicate with the pressure and return hydraulic lines connected to the actuating hydraulic cylinders 11 of the associated processing equipment.

In the apparatus, there is provided a system compensating for the working fluid flowing out from the chambers 11*a* and 11*b* of the actuating hydraulic cylinders 11 of the associated processing equipment, the inlets of the system communicating with the first diagonal "*e–k*" (*e'–k'*) of each bridge circuit of the non-return valves 8*a*–8*d* and 9*a*–9*d*.

According to the invention, the pumping arrangement is also provided with two-position three-way valves 13 and 14 with unilateral pneumatic control, and in the walls of the sleeve of the pneumatic cylinder of each hydropneumatic force multiplier 1 and 2 there are made two rows of radially arranged through openings 1*k* and 1*m* (2*k* and 2*m*). The openings 1*k* (2*k*) of one of these rows communicate through a common passage with a control chamber 13*a* (14*a*) of one of said three-way valves 13 (14), and the openings 1*m* (2*m*) of the other row with inlet passages 13*c* and 13*d* (14*c*, 14*d*) of this valve 13 (14). The distance between the rows of the radial openings 1*k* and 1*m* (2*k* and 2*m*) along the generatrix of the sleeve of a respective pneumatic cylinder is chosen such as to ensure dephasing of the pistons 1*e* (2*e*) of both force multipliers 1 and 2 in the course of their operation within a minimum time period of joint travel of the pistons 1*e* (2*e*).

The system of working fluid flow compensation is made up of four controlled now-return hydraulic valves 15, 16, 17 and 18, the outlet of each valve communicating with one of the hydraulic chambers 1*d*, 1*c*, 2*c* and 2*d*, respectively, of one of the force multipliers 1 and 2. Control and control chambers 15*a*, 16*a*, 17*a* and 18*a* of these valves 15, 16, 17 and 18 are in communication with the opposite hydraulic chambers 1*c*, 1*d*, 2*d*, 2*c*, respectively, of the force multipliers 1 and 2.

All the controlled hydraulic valves 15, 16, 17, 18 communicate through a common inlet 19 with the outlet of a hydropneumatic accumulator 20, and an inlet 21 thereof communicates through a pneumatic safety valve 22 and the reducer 12 with the air source 3.

In a second embodiment (FIG. 2) of the hydropneumatic pumping arrangement associated with processing equipment with clamping or restricting devices A there is provided a hydraulic force multiplier 23 (FIG. 2) with its high-pressure chamber 23*a* being in parallel communication with electrically controlled hydraulic directional valves 24 having controlling actuating hydraulic cylinders 25, while a stem-fitted chamber 23*b* and a stemless chamber 23*c* of this force multiplier 23 are in communication with outlet passages 26*b* and 26*a* of a two-position four-way hydraulic directional valve 26 whose inlet passages 26*c* and 26*d* communicate with a circuit 27 for automatic control of the working fluid pressure during operation of the pumping arrangement.

The circuit 27 has an "n-way" electrically controlled hydraulic directional valve 28 whose inlet 28*a* and return passage 28*b* communicate with a pressure line 29 and a return line 30, and outlets 28*c* and 28*d*, with hydraulic pressure regulators 31 and 32 which, in turn, communicate with the inlets of non-return valves 33 and 34, respectively, and the common outlet thereof communicates with the inlet 26*d* of the two-position four-way hydraulic valve 26.

Figure 3:
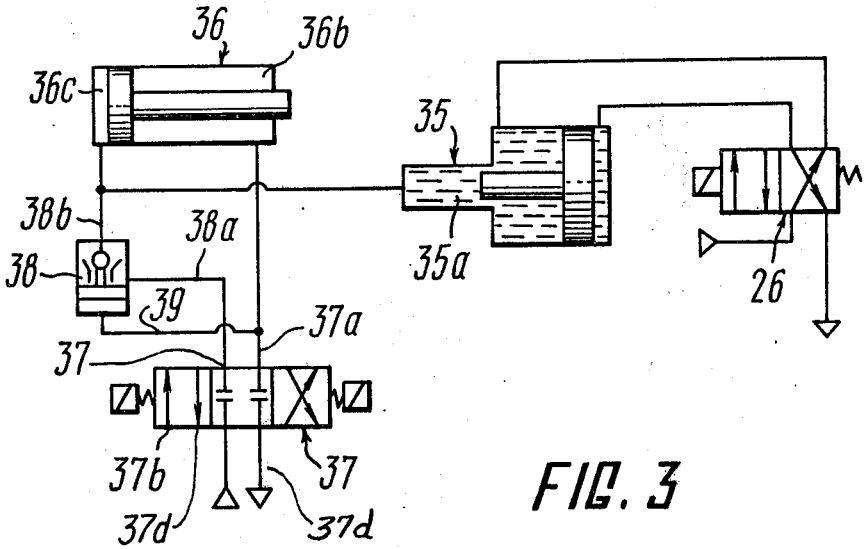
FIG. 3 shows another embodiment of an automatic fluid-pressure control circuit.

In a third embodiment of the pumping arrangement, a high-pressure chamber 35*a* (FIG. 3) of a hydraulic force multiplier 35 is in communication with stemless chambers 36*c* of actuating hydraulic cylinders 36 and is isolated from a channel 37*a* of a hydraulic directional valve 37 by means of a controlled non-return valve 38 whose inlet 38*a* communicates with an inlet 37*b* of said hydraulic valve 37. An outlet passage 38*b* of this valve 38 is in parallel communication with pressure chambers 36*c* of the actuating hydraulic cylinders 36 and with the high-pressure chamber 35*a* of the hydraulic force multiplier 35.

In this case, a control channel 39 of the non-return valve 38 is in communication with another outlet 37*d* of the hydraulic valve 37.

The principle of operation of the hydropneumatic pumping arrangement is as follows. When pressure is applied from the pneumatic line 3 (FIG. 1) to the pneumatic reducers 12, compressed air is admitted to the first two-position directional valves 4 and 6 of each pair 4 and 5 (6 and 7) of valves. The pressure is applied to the outlet passages 4*e* and 6*e* of these valves 4 and 6, then to the right-hand pneumatic chambers 1*b* and 2*b* of the pneumatic cylinders of both hydropneumatic force multipliers 1 and 2 which at this moment are at rest, against the left-hand stop.

From the chamber 1*b* of the force multiplier 1, through two rows of openings 1*k* and 1*m* in the sleeve of its pneumatic cylinder, pneumatic signals are applied, respectively, to the control chamber 13*a* and inlet passage 13*c* of the two-position three-way valve 13. As a result, the valve 13 is switched into a position whereat the pneumatic control signal from the row of through openings 1*m* in the sleeve of the pneumatic cylinder of the force multiplier 1 is fed to the outlet passage 13*c* of the valve 13 and on to the inlet passage 5*c* of the second two-position directional valve 5 of the first pair of valves 4 and 5.

Control pressure from the outlet passage 4*e* of the first valve 4 is applied to the control chamber 5*b* of the second valve 5 of the same pair of valves 4 and 5 and shifts it to the right (FIG. 1) position whereat the pneumatic signal from the inlet passage 5*c* of the second valve 5 is fed to the outlet passage 5*e* thereof and on to the control chamber 6*b* of the first valve 6 of the second pair of valves 6 and 7.

Simultaneously, a pneumatic signals from the right pneumatic chamber 2*b* of the pneumatic cylinder of the force multiplier unit 2, via two rows of through openings 2*k* and 2*m* in the sleeve of its pneumatic cylinder, are fed to the control chamber 14*a* and inlet passage 14*c* of the two-position three-way valve 14.

As a result, the valve 14 is switched into a position whereat the pneumatic control signal from the row of through openings 2*m* in the sleeve of the pneumatic cylinder of the force multiplier 2 enters the outlet passage 14*c* of the valve 14, then proceeds to the outlet passage 7*e* of the second valve 7 of the second pair of valves 6 and 7.

The control pressure from the outlet channel 6*e* hydraulic of the first two-position valve 6 is applied to the control chamber 7*b* of the second valve 7 of the second pair of valves 6 and 7, shifting it to the right-hand position whereat the pneumatic signal from the inlet passage of the valve 7*c* is fed to the outlet passage 7*e* and on to the control chamber 4*a* of the first valve 4 of the first pair of valves 4 and 5.

As a result, the valve 4 is switched into the left-hand position (from that shown in FIG. 1) whereat pressure is applied to the outlet 4*d* and on to the left pneumatic chamber 1*a* of the pneumatic cylinder of the force multiplier 1, and the right pneumatic chamber 1*b* thereof is in communication with the atmosphere.

Consequently, the piston 1*e* of the force multiplier 1 starts moving to the right, forcing the fluid from the hydraulic chamber 1*d* into the hydraulic system. As a result of this movement, compressed-air control pressure from the outlet passage 4*d* of the valve 4 is applied to the control chamber 5*a* of the second valve 5, switching it to the left-hand position.

Simultaneously, the pneumatic signals fed from the pneumatic chamber 1*b* of the force multiplier 1 through the openings 1*k* and 1*m* to the valve 13 are removed since the right chamber 1*b* of the force multiplier 1 is at that moment in communication with the atmosphere whereby the valve 13 is switched into the initial right-hand position (FIG. 1).

As the piston 1*e* of the force multiplier 1 moves to the right, it blocks the row of openings 1*k*, and the pneumatic signal is fed to a control chamber 13*a* of the valve 13, switching it into the left position.

As the piston 1*e* of the force multiplier 1 continues moving to the right it passes by the row of openings 1*m*, and a control pneumatic signal is fed to the inlet channel 13*c* of the valve 13, which then proceeds to the input 5*c* of the valve 5, to its outlet passage 5*d*, and on to the control chamber 6*a* of the pneumatic valve 6 of the force multiplier 2.

As a result the valve 6 is switched into the left position and the working pressure is supplied to the outlet passage 6*d*, then to the left pneumatic chamber 2*a* of the pneumatic cylinder of the force multiplier 2. The right pneumatic chamber 2*b* of the pneumatic cylinder of the force multiplier 2 communicates with the atmosphere through the outlet passage. The piston communicates with the atmosphere. The piston 2*e* of the force multiplier 2 starts moving to the right, forcing the working fluid from its hydraulic chamber 2*d* into the hydraulic line of the apparatus.

At the same time, the piston 1*e* of the force multiplier 1 continues moving to the right as far as it will go, whereupon the working fluid is forced only by the multiplier 2. As the pneumatic valve 6 is switched into the left position, the control pressure is supplied from the outlet passage 6*d* into the control chamber 7*a* of the valve 7, shifting it to the left position.

The right pneumatic chamber of the force multiplier 2 being in communication with the atmosphere removes the pneumatic signals from the control chamber 14*a* of the valve 14 through the rows of openings 2*k*, and from the inlet passage 14*e* of the same valve through the rows of openings 2*m* in the sleeve of the pneumatic cylinder of the force multiplier 2, whereby the valve 14 is switched to the initial left-hand position.

As the piston 2*e* of the force multiplier 2 moves to the right, it successively passes by the openings 2*k* and 2*m*, thus causing the pneumatic signal to appear at the outlet 7*d* of the distributor 7. The signal enters the control chamber 4*a* of the valve 4 and switches it to the right-hand position, thereby actuating the force multiplier 1 and preparing the valve 13 for the next working cycle. In this case the working fluid is forced into the hydraulic line from the hydraulic chamber 1*d* of the force multiplier 1.

This is how continuous forcing of the working fluid into the hydraulic line and rigid coupling of the beginning and end of a working cycle of one force multiplier as a function of the other's movement are effected. This allows elimination of cycle disturbances of the system, occuring in known pumping arrangements, owing to the synchronized reversal of the force multipliers 1 and 2. The arrangement is switched on and starts its working cycle automatically regardless of the initial position of the pistons 1*e* and 2*e* of the force multipliers 1 and 2, directional valves 4, 5, 6 and 7 and valves 13 and 14.

When the working fluid is forced from the hydraulic chamber 1*d* of the force multiplier 1, pressure is supplied to the inlet of the hydraulic non-return valve 8*d*, then, successively, from the hydraulic line to the inlet of the valve 10 and on to the pressure chamber 11*b* of the actuating hydraulic cylinder 11.

The working fluid from the return chamber 11*a* of the actuating hydraulic cylinder 11 is admitted through a respective passage of the valve 10 into the return line and, through the hydraulic non-return valve 8*b* of the bridge circuit into the hydraulic chamber 1*d* of the hydropneumatic force multiplier 1.

Owing to the volumetric difference of the stem-fitted chamber 11*a* and the stemless chamber 1*b* of the actuating hydraulic cylinder 11, the amount of working fluid forced out from the hydraulic chamber 1*c* of the force multiplier 1 equals that forced into the hydraulic chamber 1*d*.

When the working fluid is forced from the stem chamber 11*a* of the actuating hydraulic cylinder 11, its amount entering the hydraulic chamber 1*d* of the force multiplier 1 is less than that forced out of the hydraulic chamber 1*c* of the multiplier 1 and vice versa, the compensation for the outflowing amount of the working fluid being provided by the controlled hydraulic non-return valve 15 opened by the control pressure from the hydraulic chamber 1*c* of the force multiplier 1 and ensuring two-way communication between the hydraulic chamber 1*d* and the hydropneumatic accumulator 20.

From the accumulator 20 an additional amount of working fluid is fed to the hydraulic system, for which purpose an excessive amount of pressure is maintained therein that is controlled by adjustment of the hydraulic reducer 12 and the pneumatic safety valve 22.

As the piston 1*e* of the force multiplier 1 moves to the right, the working fluid, under pressure from the hydraulic chamber 1*d* thereof, is directed to the non-return valves 8*d* and 8*b* of the hydraulic bridge circuit and on, through the diagonal "*l–m*" thereof, into the pressure line to the actuating hydraulic cylinder 11. From the return line, through the non-return valve 8*a* of the hydraulic bridge circuit, the liquid is delivered into the hydraulic chamber 1*c* of the force multiplier 1.

Compensation for the volumetric difference between the stem-fitted and stemless chambers 11*a*, 11*b* of the actuating hydraulic cylinder 11 is provided by the controlled hydraulic non-return valve 16 connecting the hydraulic chamber 1*c* of the force multiplier 1 with the accumulator 20 and by the control pressure from the respective chamber 1*d* of the force multiplier 1.

In a similar way, the working cycle in the hydaulic line is performed in the case of the hydropneumatic force multiplier 2.

A valve 40 (FIG. 1) is provided in the pumping arrangement which enables rapid removal of air from the hydraulic system when it is being filled with the working fluid.

Thus, the actuating hydraulic cylinder 11 is actuated by an invariable amount of the working fluid transferred from one hydraulic chamber of the force multipliers 1 and 2 into the other and vice versa.

The proposed control circuit of the hydropneumatic pumping arrangement has a rigid coupling relative to the working fluid flow in the actuating hydraulic cylinder 11 and the pressure source, which provides for optimal power consumption by the pressure source with respect to the fluid flow at any moment.

Figure 2:
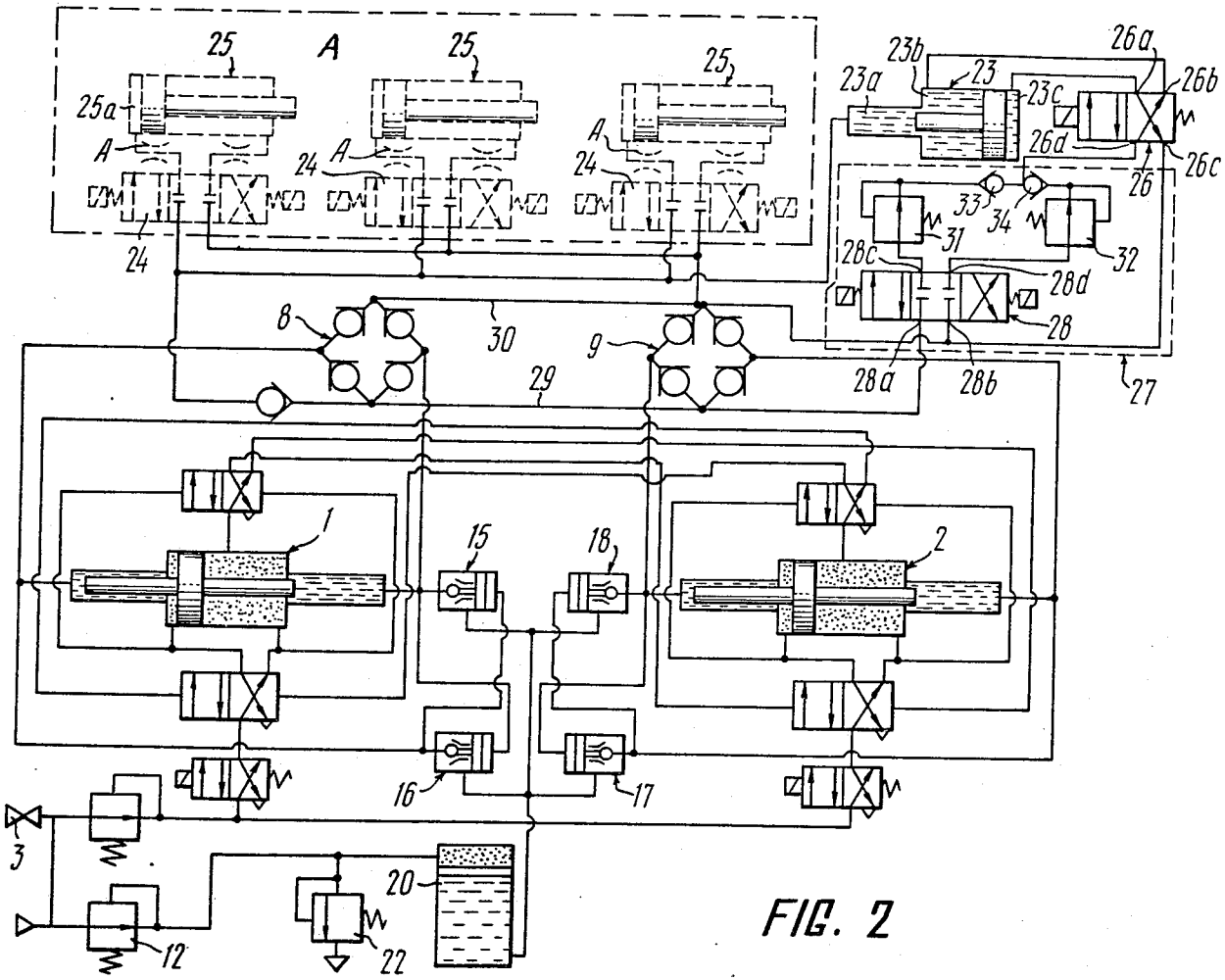
FIG. 2 shows the pumping arrangement of FIG. 1 associated with processing equipment having clamping devices.

The hydropneumatic pumping arrangement, intended preferably, for use with processing equipment having multiple clamping devices, operates as follows. In the initial position, as shown in FIG. 2, the pistons of the actuating hydraulic cylinders 25 are in the extreme left-hand positions, their hydraulic directional valves 24 being in a neutral position, while the hydraulic force multiplier 23 and its hydraulic directional valve 26 are in the right-hand position. The hydraulic valve 28 may be in any position depending on the working cycle and the sequence of the workpieces being clamped by devices A.

When the left-hand solenoids of the hydraulic valves 24 are energized, the latter are switched to the left position, resulting in the working fluid pressure from the pressure line of the pumping arrangement being supplied into the stemless chambers 25*a* of the actuating hydraulic cylinders 25, and their pistons shift the clamping device A to the upward position.

When the device A is brought to the clamping position, a final switch (not shown) operates the hydraulic valves 26 and 28 (or only 26, if the valve 28 is already in one of the extreme positions).

The hydraulic valves 26 and 28 being switched to the left positions, supply pressure into the stemless chamber 23*c* of the hydraulic force multiplier 23, whose stem starts moving to the left directing the fluid from the high pressure chamber 23*a* to the inlet of the hydraulic valves 24 and on into the stemless chambers 25*a* of the hydraulic cylinders 25, under a pressure exceeding that built up by the hydropneumatic pumping arrangement to the same extent as the cross-sectional area of the low-pressure chamber of the force multiplier 23, exceeds a respective area of the high pressure chamber 23*a* thereof with regard for throttling by the regulators 31 and 32 that are adjusted to the working pressure in accordance with the required clamping force.

The hydraulic valve 28 in the left or right working positions provides for fluid supply from the pressure hydraulic line of the pumping arrangement into the low-pressure chamber of the hydraulic force multiplier 23 through the regulators 31 and 32 adjusted to different working pressures, whereby different clamping forces are automatically selected during a working cycle.

Since the hydraulic force multiplier 23 operates practically without reciprocation of the pistons of the actuating hydraulic cylinders 25, the fluid flow from the force multiplier 23 is negligible and should only compensate for leakage in the high-pressure circuit that includes only the hydraulic valves 24. At the same time, the regulators 31 and 32 having considerable leakage of the working fluid, are switched from the high-pressure circuit of the force multiplier 23 to the low-pressure circuit of the pumping arrangement, that permits this leakage to be ignored when chosing the volume of the high-pressure chamber 23*a* of the force multiplier 23, hence, its dimensions.

On completion of a processing cycle under elevated pressure, the hydraulic valves 24 and 26 are switched to the right positions (the right-hand solenoids of the hydraulic valves 24 are energized and the solenoid of the hydraulic valve 26 is deenergized, which causes the pistons of the hydraulic cylinders 25 to move to the extreme left positions, and the piston of the force multiplier 23 to return to the initial position).

The hydraulic valve 28 may be switched both on completion of a processing cycle and during it, changing thereby the clamping force during the working cycle (if it is required by the process).

In the third embodiment of the pumping arrangement, leaky units are excluded from the high-pressure circuit of the hydraulic force multiplier 35. The high-pressure chamber 35*a* of this multiplier 35 is directly connected with the stemless chamber 36*c* of the actuating hydraulic cylinder 36 and isolated from the pressure line of the pumping arrangement by means of the controlled non-return valve 38.

The third embodiment is recommended for cases where the production process necessitates maintaining the high pressure in the equipment for a long time.

What is claimed is:

1. A hydropneumatic pumping arrangement comprising: at least two double-acting hydropneumatic force multipliers having respective pistons; each having a pneumatic cylinder with two pneumatic chambers and two hydraulic chambers; two pairs of two-position directional valves in the form of cylindrical slide valves with two control chambers, an inlet passage of one directional valve in each pair of valves being in communication with an air source, and outlet passages thereof being in parallel communication with said pneumatic chambers of one force multiplier and with said control chambers of the other directional valve of the same pair of valves; outlet passages thereof being in parallel communication with said control chambers of said one directional valve of the other pair of valves for alternative communication of said pneumatic chambers with said air source in the course of travel of said pistons; interconnected hydraulic non-return valves forming two bridge circuits, one diagonal of each circuit being in communication with said hydraulic chambers of one force multiplier; hydraulic pressure and return lines communicating with the other diagonal of each circuit, for connection thereto of actuating hydraulic cylinders of the associated processing equipment; and a system for compensating working fluid flowing out of said chambers at said actuating cylinders, inlets of said system being in communication with said one diagonal of each bridge circuit.

2. The pumping arrangement as defined in claim 1, further comprising two two-position three-way valves with unilateral pneumatic control and two rows of radially arranged through openings made in walls of pneumatic cylinder sleeves of said force multipliers; openings of one of these rows being in communication, through a common passage, with a control chamber of one of said two-position valves, and openings of the other row communicating with an inlet passage of said two-position valves; the distance between said rows along the generatrices of said cylinder sleeves being selected such as to ensure dephasing of said pistons of both force multipliers in the course of their operation, the time of one of the pistons holding against the stop position being minimum.

3. The pumping arrangement as defined in claim 1, wherein said compensating system is made up of four controlled hydraulic non-return valves, outlets of these valves being in communication with one of said hydraulic chambers of one force multiplier, and said control chambers of the controlled non-return valves being in communication with the opposite hydraulic chamber of the same force multiplier, all controlled non-return valves being in communication, through a common inlet, with an outlet of a hydropneumatic accumulator whose inlet, through a pneumatic safety valve and a pneumatic reducer, is in communication with said air source.

4. The pumping arrangement as defined in claim 1, further comprising a hydraulic force multiplier having a high-pressure chamber in communication with hydraulic directional valves of actuating hydraulic cylinders; a stem-fitted and a stemless chamber of said hydraulic force multiplier being in communication with outlets of a two-position four-way directional valve, outlet passages thereof being in communication with an automatic control circuit for the working-fluid pressure in the course of operation.

5. The pumping arrangement as defined in claim 4, wherein said control circuit includes an "n-way" electrically controlled hydraulic directional valve whose inlet and return passages are in communication with said pressure and return lines and whose outlets communicate with hydraulic pressure regulators which, in turn, are in communication with inlets of non-return valves, and their common outlet is in communication with an inlet of said two-position four-way directional valve, the inlets thereof being connected to said chambers.

6. The pumping arrangement as defined in claim 1, further comprising a hydraulic force multiplier having a high-pressure chamber in communication with stem-fitted and stemless chambers of actuating hydraulic cylinders, isolated from one outlet passage of a hydraulic directional valve, inlet passages of said valve being in parallel communication with said chambers of the actuating hydraulic cylinders and with said high-pressure chamber, a control passage of said hydraulic non-return valve being in communication with another outlet passage of said hydraulic directional valve.

* * * * *